US006024073A

United States Patent [19]

Butt

[11] Patent Number: 6,024,073

[45] Date of Patent: Feb. 15, 2000

[54] HYDROCARBON FUEL MODIFICATION DEVICE AND A METHOD FOR IMPROVING THE COMBUSTION CHARACTERISTICS OF HYDROCARBON FUELS

[76] Inventor: David J. Butt, 85 Chipstone CLS., Unit 314, Halifax, Canada, B3M 4H7

[21] Appl. No.: 09/113,819

[22] Filed: Jul. 10, 1998

[51] Int. Cl.[7] ..... F02B 75/12; F02M 27/00

[52] U.S. Cl. ..... 123/538; 44/321; 44/354

[58] Field of Search ..... 123/538, 536; 44/321, 354; 431/2

[56] References Cited

U.S. PATENT DOCUMENTS

| | | | |
|---|---|---|---|
| 2,231,605 | 2/1941 | Stephenson et al. . | |
| 4,050,426 | 9/1977 | Sanderson . | |
| 4,201,140 | 5/1980 | Robinson . | |
| 4,254,393 | 3/1981 | Robinson . | |
| 4,357,237 | 11/1982 | Sanderson . | |
| 4,372,852 | 2/1983 | Kovacs . | |
| 4,381,754 | 5/1983 | Heckel . | |
| 4,429,665 | 2/1984 | Brown . | |
| 4,461,262 | 7/1984 | Chow . | |
| 4,517,926 | 5/1985 | Reinhard et al. . | |
| 4,568,901 | 2/1986 | Adam . | |
| 4,569,737 | 2/1986 | Sakata . | |
| 4,715,325 | 12/1987 | Walker . | |
| 4,716,024 | 12/1987 | Pera . | |
| 4,808,306 | 2/1989 | Mitchell et al. . | |
| 4,930,483 | 6/1990 | Jones . | |
| 4,968,396 | 11/1990 | Harvey . | |
| 4,999,106 | 3/1991 | Schindler . | |
| 5,013,450 | 5/1991 | Gomez . | |
| 5,048,498 | 9/1991 | Cardan . | |
| 5,048,499 | 9/1991 | Daywalt . | |
| 5,059,217 | 10/1991 | Arroyo et al. . | |
| 5,059,743 | 10/1991 | Sakuma . | |
| 5,076,246 | 12/1991 | Onyszczuk . | |
| 5,124,045 | 6/1992 | Janczak et al. . | |
| 5,127,385 | 7/1992 | Dalupin . | |
| 5,129,382 | 7/1992 | Stamps et al. . | |
| 5,154,153 | 10/1992 | MacGregor | 123/538 |
| 5,154,807 | 10/1992 | Harvey . | |
| 5,161,512 | 11/1992 | Adam et al. . | |
| 5,167,782 | 12/1992 | Marlow | 204/168 |
| 5,197,446 | 3/1993 | Daywalt et al. . | |
| 5,227,683 | 7/1993 | Clair . | |
| 5,249,552 | 10/1993 | Brooks | 123/1 A |
| 5,269,916 | 12/1993 | Clair . | |
| 5,307,779 | 5/1994 | Wood et al. . | |
| 5,368,705 | 11/1994 | Cassidy . | |
| 5,393,723 | 2/1995 | Finkl . | |
| 5,404,913 | 4/1995 | Gilligan . | |
| 5,431,797 | 7/1995 | Harvey . | |
| 5,487,370 | 1/1996 | Miyazaki . | |
| 5,520,158 | 5/1996 | Williamson . | |
| 5,524,594 | 6/1996 | D'Alessandro | 123/538 |
| 5,533,490 | 7/1996 | Pascall . | |
| 5,580,359 | 12/1996 | Wright | 44/321 |
| 5,589,065 | 12/1996 | Bogatin et al. . | |
| 5,671,719 | 9/1997 | Jeong . | |
| 5,738,692 | 4/1998 | Wright . | |

*Primary Examiner*—Noah P. Kamen
*Assistant Examiner*—Hai Huynh
*Attorney, Agent, or Firm*—Mario D. Theriault

[57] ABSTRACT

A fuel modification device comprising a casing having an inlet fitting, an outlet fitting and a flow axis between the inlet fitting and the outlet fitting. The casing encloses a plurality of catalytic pellets held in layers by at least two spaced-apart Monel screens positioned perpendicularly relative to the flow axis. The casing also encloses at least one magnet positioned adjacent to and without touching, one of the Monel screens. The magnet contains at least one element from a group of elements comprising strontium and barium. The catalytic pellets comprises the following composition percentages by weight: 2–7% bismuth; 3–7% mercury; 70–80% tin; and 15–25% antimony. There is further provided a method for treating hydrocarbon fuel within the device wherein an electrolytic action is caused to occur between the fuel and the magnet for causing some of the oxygen molecules in the water impurities to separate from the fuel impurities and to bond to the hydrocarbon molecules as oxygenates. There is also provided a method for freeing radicals of hydrogen from the water impurities and for causing some of the radicals of hydrogen to join hydrocarbon chains within the fuel for forming new and shorter hydrocarbon chains.

30 Claims, 3 Drawing Sheets

HYDROCARBON FUEL MODIFICATION DEVICE AND A METHOD FOR IMPROVING THE COMBUSTION CHARACTERISTICS OF HYDROCARBON FUELS

FIELD OF THE INVENTION

This invention pertains to a device and a method for enhancing the pre-combustion properties of hydrocarbon fuels. More particularly, the present invention pertains to a device and a method for treating hydrocarbon fuels and hydrogen-containing impurities present in the fuels, with a catalytic-magnetic-electrolytic process.

BACKGROUND OF THE INVENTION

Fuel treating devices have been known since at least the second world war. A well documented wartime success story tells of Henry Broquet, a young RAF technician who worked with Russian scientists and developed a metallic fuel catalyst which enabled the Rolls Royce Merlin engines in RAF Hurricane fighter planes loaned to the Russians to help in the war effort, to run on low-octane fuel available at that time in Russia.

This invention and others have led to the development of a highly varied quantity of devices for enhancing the burning properties of hydrocarbon liquid fuels. The fuel modification devices of the prior art are believed to belong to three broad groups. The first group utilizes magnetic energy; the second group uses a catalytic action or a combination of a magnetic-catalytic action, and the third group utilizes an electrolytic-catalytic reaction.

Examples of fuel modification devices of the first group wherein the fuel is circulated across or along the flux lines of a magnetic field, are disclosed in the following patent documents:

U.S. Pat. No. 4,050,426 issued on Sep. 27, 1977 to C. H. Sanderson;
U.S. Pat. No. 4,201,140 issued on May 6, 1980 to T. G. Robinson;
U.S. Pat. No. 4,254,393 issued on Mar. 3, 1981 to T. G. Robinson;
U.S. Pat. No. 4,357,237 issued on Nov. 2, 1982 to C. H. Sanderson;
U.S. Pat. No. 4,372,852 issued on Feb. 8, 1983 to A. J. Kovacs;
U.S. Pat. No. 4,381,754 issued on May 3, 1983 to K. Heckel;
U.S. Pat. No. 4,461,262 issued on Jul. 24, 1984 to E. Chow;
U.S. Pat. No. 4,568,901 issued on Feb. 4, 1986 to H. J. Adam;
U.S. Pat. No. 4,569,737 issued on Feb. 11, 1986 to H. Sakata;
U.S. Pat. No. 4,716,024 issued on Dec. 29, 1987 to I. Pera;
U.S. Pat. No. 4,808,306 issued on Feb. 28, 1989 to J. Mitchell et al.;
U.S. Pat. No. 4,999,106 issued on Mar. 12, 1991 to R. H. Schindler;
U.S. Pat. No. 5,048,498 issued on Sep. 17, 1991 to A. Cardan;
U.S. Pat. No. 5,059,743 issued on Oct. 22, 1991 to T. Sakuma;
U.S. Pat. No. 5,076,246 issued on Dec. 31, 1991 to B. Onyszczuk;
U.S. Pat. No. 5,124,045 issued on Jun. 23, 1992 to A. Janczak et al.;
U.S. Pat. No. 5,127,385 issued on Jul. 7, 1992 to R. V. Dalupin;
U.S. Pat. No. 5,129,382 issued on Jul. 14, 1992 the R. D. Stamps, Sr. et al.;

U.S. Pat. No. 5,161,512 issued on Nov. 10, 1992 to L. L. Adam et al.;
U.S. Pat. No. 5,227,683 issued on Jul. 13, 1993 to C. Clair;
U.S. Pat. No. 5,269,916 issued on Dec. 14, 1993 to C. Clair;
U.S. Pat. No. 5,487,370 issued on Jan. 30, 1996 to M. Miyazaki;
U.S. Pat. No. 5,520,158 issued on May 28, 1996 to D. G. Williamson;
U.S. Pat. No. 5,533,490 issued on Jul. 9, 1996 to P. Brian;
U.S. Pat. No. 5,589,065 issued on Dec. 31, 1996 to J. G. Bogatin et al.;
U.S. Pat. No. 5,671,719 issued on Sep. 30, 1997 to T. Y. Jeong;

The effect of a magnetic field is believed to orientate the molecules in the fuel. It is also believed that the magnetic field reduces the surface tension of the fuel to allow a more complete vaporization and a better oxidation. It is further believed that the magnetization of a fuel breaks down the bonds between the hydrocarbon chains which result in decreased density and, hence, smaller particles and droplets during atomization or injection within an internal combustion engine. Smaller particles and droplets causes increased evaporation rates, improved mixing of fuel with air, and improved promotion of oxidation.

According to Colonel Clair in U.S. Pat. No. 5,227,683, in particular, the application of magnetism to hydrocarbon fuels is known to ionize the molecules of the fuel. Such ionization is taught to be very effective in increasing the combustion efficiency of hydrocarbon fuels by affording a more complete mixing of the fuel and air molecules. Furthermore, Minoru Miyazaki teaches in U.S. Pat. No. 5,487,370, that magnetic forces tend to separate fuel particles into smaller fragments for an improved combustion efficiency.

Examples of fuel modification devices of the second group wherein the fuel is brought into intimate contact with a metallic alloy having catalytic properties, are disclosed in the following series of patent documents. In these documents, it is taught generally, that the catalyst coming into contact with the hydrocarbon fuel alters the distribution of electrical charges across the structure of the fuel molecules to enhance atomization of the fuel prior to combustion. Some of the disclosed devices use a magnetic or electric field in close proximity of the catalyst. These documents are as follows:

U.S. Pat. No. 2,231,605 issued on Feb. 11, 1941 to W. G. Stephenson et al.;
U.S. Pat. No. 4,429,665 issued on Feb. 7, 1984 to B. H. Brown;
U.S. Pat. No. 4,517,926 issued on May 21, 1985 to G. G. Reinhard et al.;
U.S. Pat. No. 4,715,325 issued on Dec. 29, 1987 to C. W. Walker;
U.S. Pat. No. 4,930,483 issued on Jun. 5, 1990 to W. R. Jones;
U.S. Pat. No. 5,013,450 issued on May 7, 1991 to L. Gomez;
U.S. Pat. No. 5,048,499 issued on Sep. 17, 1991 to C. L. Daywalt;
U.S. Pat. No. 5,059,217 issued on Oct. 22, 1991 to M. L. Arroyo et al.;
U.S. Pat. No. 5,167,782 issued on Dec. 1, 1992 to J. R. Marlow;
U.S. Pat. No. 5,197,446 issued on Mar. 30, 1993 to C. L. Daywalt et al.;
U.S. Pat. No. 5,249,552 issued on Oct. 5, 1993 to D. M. Brooks;
U.S. Pat. No. 5,307,779 issued on May 3, 1994 to D. W. Wood et al.;

U.S. Pat. No. 5,368,705 issued on Nov. 29, 1994 to S. Cassidy;

U.S. Pat. No. 5,393,723 issued on Feb. 28, 1995 to A. W. Finkl;

U.S. Pat. No. 5,404,913 issued on Apr. 11, 1995 to M. Gilligan;

U.S. Pat. No. 5,524,594 issued on Jun. 11, 1996 to G. D'Alessandro;

U.S. Pat. No. 5,533,490 issued on Jul. 9, 1996 to B. Pascall;

U.S. Pat. No. 5,580,359 issued on Dec. 3, 1996 to R. Wright;

U.S. Pat. No. 5,738,692 issued on Apr. 14, 1998 to R. H. Wright;

Although the mechanics or chemistry involved in the effects of a catalyst over hydrocarbon fuels remains largely unexplained, Claud W. Walker for example, teaches in U.S. Pat. No. 4,715,325, that placing an hydrocarbon fuel in intimate contact with a crystalline metal alloy containing copper, zinc, nickel, lead and tin, causes a polarization of the molecules of the fuel, or a change in electrostatic potential of the flowing hydrocarbon molecules to achieve increased performance, and consequently better gasoline mileage.

Ralph H. Wright offers a rational explanation for the catalytic transformation of a fuel in U.S. Pat. No. 5,738,692. The teachings of this patent are that a gasoline treatment using a catalyst containing tin, antimony, lead and mercury appears to increase octane and energy content of gasoline by forming aromatic compounds, most likely by cracking longer-chain paraffins. When the same catalyst is used with diesel fuels, the long-chain paraffins appear to be broken up to form lower molecular weight saturated alkanes which are more efficiently burned.

In the third group of fuel modification devices of the prior art using a catalytic and electrolytic pre-treatment of hydrocarbon fuels, the following examples are found:

U.S. Pat. No. 4,968,396 issued on Nov. 6, 1990 to D. M. Harvey;

U.S. Pat. No. 5,154,807 issued on Oct. 13, 1992 to D. M. Harvey;

U.S. Pat. No. 5,431,797 issued on Jul. 11, 1995 to D. M. Harvey;

In the first above-mentioned patent, Draper M. Harvey teaches that the combined catalytic-electrolytic pre-treatment of hydrocarbon fuel tends to modify or alter the structure of the fuel, generating hydroxyl ions and hydrogen oxides within the fuel the former having been found effective to scavenge or substantially eliminate undesired combustion by-products such as carbon monoxides, hydrocarbon particulate and nitrogen oxide. It has been found that the hydrogen oxides within the fuel mixture act beneficially as a fuel additive to reduce octane requirement. The hydrogen oxides also serve as effective carriers of primary oil lubricants to reduce wear factors of engine components.

In the invention of the second-mentioned U.S. Pat. No. 5,154,807, a zinc-silver anode-cathode is used to extract one atom of hydrogen from molecules of water present in the fuel to promote the formation of the scavenging hydroxyl ions (OH).

Although the fuel modification devices and methods of the prior art deserve undeniable merits, there is no known prior art that combines the advantages of a catalytic action, magnetic energy, and an electrolytic reaction in a simple and compact embodiment which can be used on internal combustion engines and burners of boilers and furnaces alike for improving the combustion properties of the fuel burnt in these equipment. Furthermore, there is no known prior art which combines a catalytic action complemented by magnetic energy and an electrolytic reaction for advantageously using the water impurities within the fuel, for breaking down these water impurities, and for modifying the fuel by adding to it a corresponding quantity of oxygen and hydrogen molecules.

SUMMARY OF THE INVENTION

The fuel modification devices of the present invention, however, use a catalyst, one or a more magnetic fields and an electrolytic action within the fuel for further improving the conditioning and oxidation of the fuel. The material of construction of the components inside the fuel modification devices of the present invention are selected to advantageously enhance an electrolytic reaction within the fuel, for breaking down the water impurities within the fuel and for using oxygen and hydrogen radicals from these impurities to beneficially modify the fuel.

The fuel modification devices of the present invention are designed for installation on internal combustion engines running on diesel oil or gasoline, on burners of furnaces and boilers, and virtually any other equipment burning liquid fossil fuel. The devices are typically mountable in the fuel line between the fuel filter and the fuel pump of the equipment.

It is well known that fuel tanks, tankers and fuel lines are often subject to condensation and therefore most petroleum fuels contain traces of water. The triple action of a catalyst, magnetic fields and electrolyse of the devices of the present invention is believed to react with the dissolved water content of the fuel, to free radicals of hydrogen and radicals of oxygen as well as other magnetically responsive materials within the fuel. The hydrogen molecules are then free to join with some of the hydrocarbon chains forming new and shorter hydrocarbon chains or increasing the abundance of the hydrocarbon chains. Some of the oxygen is believed to join with elements in the fuel thereby forming oxides, or are believed to be used in the combustion process itself as oxygenates. The reformed fuel is easier to atomise and requires less oxygen for complete combustion. The reformed fuel is easier to ignite and is more completely combusted thereby reducing emissions in the exhaust and carbon deposits in the combustion chamber.

In a first aspect of the present invention there is provided a fuel modification device comprising a casing having an inlet fitting, an outlet fitting and a flow axis between the inlet fitting and the outlet fitting. The casing encloses a plurality of catalytic pellets held in layers by at least two spaced-apart Monel screens positioned perpendicularly relative to the flow axis. The casing also encloses at least one magnet positioned adjacent to and without touching, one of the Monel screens. The magnet contains at least one element from a group of elements comprising strontium and barium.

The primary advantage of this arrangement is that when an hydrocarbon fuel is adapted to flow through the casing and when that fuel contains water impurities, an electrolytic action is believed to be generated through the fuel between two or more elements from the Monel screen, the magnet and the catalytic pellets, for breaking the water impurities in the fuel into oxygen and hydrogen radicals of these water impurities. These oxygen and hydrogen radicals are therefore free to combine to the hydrocarbon chains to improve the combustion characteristics of the fuel.

According to a second aspect of the present invention, there is provided a catalytic fuel modification device containing a plurality of catalytic pellets wherein at least one of the catalytic pellets comprises the following elements and composition percentages by weight: 2–7% bismuth; 3–7% mercury; 70–80% tin; and 15–25% antimony.

The catalyst of the present invention does not contain lead as many of the alloy-based systems of the prior art. Lead is known to be a serious environmental contaminant that has already been eliminated from all gasolines and that is presently being eliminated from numerous conventional applications such as a sealant and brazing material for water piping systems for examples. The catalyst of the present invention is therefore more environmentally acceptable as a fuel treatment alloy than those systems of the prior art containing lead where lead may be traced into the fuel and into the combustion residues.

According to another aspect of the present invention, there is provided a fuel modification device comprising a grounded steel casing and a plurality of catalytic pellets held in layers by at least two spaced-apart Monel screens, and at least two magnets positioned adjacent to and without touching, one of the Monel screens. The magnets contain at least one element from a group of elements comprising strontium and barium. There is also provided an electrical connection between the casing and one of the magnets for causing a slight electrostatic field to occur through the hydrocarbon fuel, between the magnets or between one of the magnets and the Monel screens or between one of the magnets and the catalytic pellets, or between one of the magnets and the hydrocarbon fuel, for further promoting an electrolytic reaction in the water impurities present in the fuel.

In a further aspect of the present invention, there is provided a method for improving the combustion characteristics of hydrocarbon fuels containing water impurities. This new method comprises the steps of:

a) immersing in the fuel a first catalytic composition comprising bismuth, mercury, tin and antimony;

b) immersing in the fuel a magnet containing at least one element from a group of elements comprising strontium and barium;

c) immersing in the fuel at proximity of but without touching the magnet, a metallic alloy member comprising copper and nickel;

d) flowing the fuel over the catalyst, over the alloy member and over the magnet;

e) causing an electrolytic action to occur through the fuel, between magnet and the metallic alloy member or the catalytic composition;

f) causing some hydrocarbon molecules in the fuel to become ionized;

g) causing some of the oxygen molecules in the fuel impurities to separate from the fuel impurities and to bond to the hydrocarbon molecules as oxygenates.

In a further aspect of the present invention, there is provided a second method for improving the combustion characteristics of hydrocarbon fuels containing water impurities. This second method is similar to the aforesaid new method but further comprises the additional steps of:

h) freeing radicals of hydrogen from the water impurities; and i) causing some of the radicals of hydrogen to join hydrocarbon chains within the fuel for forming new and shorter hydrocarbon chains.

The fuel modification device and method for improving the combustion characteristics of hydrocarbon fuel of the present invention have been tested on internal combustion engines and have demonstrated numerous beneficial advantages such as: reduced exhaust emissions, increased horsepower, reduced fuel consumption, reduced exhaust gas temperature, improved turbo boost performance, cleaner fuel system components and less friction inside the engine.

BRIEF DESCRIPTION OF THE DRAWINGS

Having briefly explained the theory inherent the fuel modification devices of the present invention and some of the advantages thereof, the structure of these devices are described herein in greater details with reference to the accompanying drawings, in which.

DETAILED DESCRIPTION OF THE PREFERRED EMBODIMENTS

Figure 1:
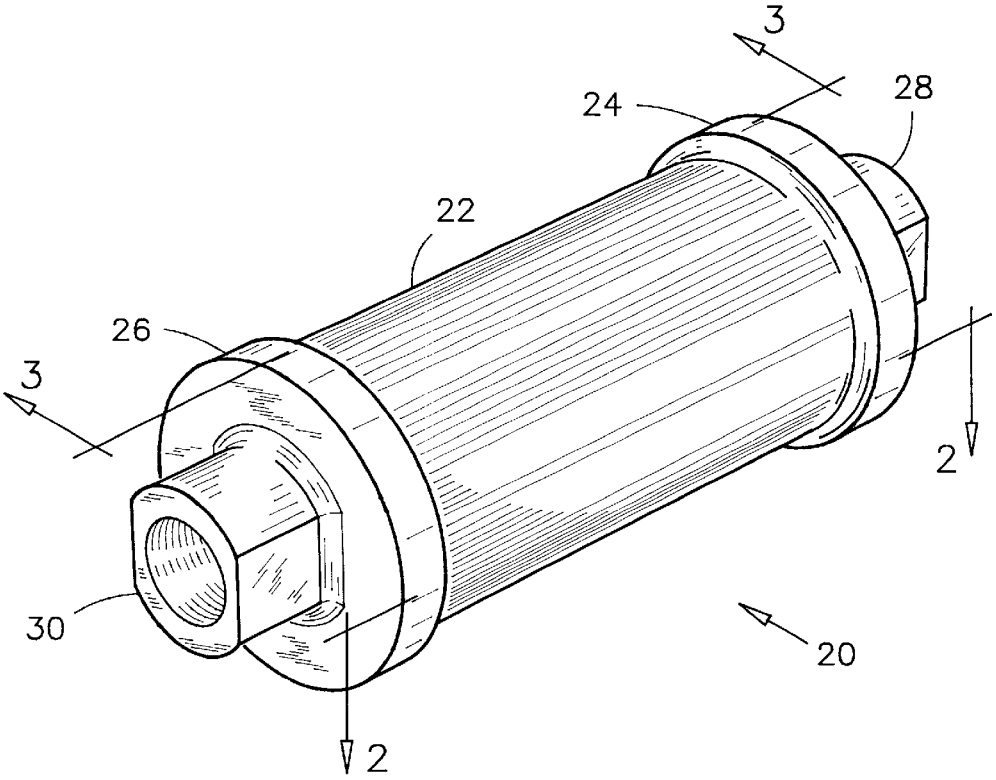
FIG. 1 is a side and outlet end perspective view of the fuel modification device of the first preferred embodiment.
Figure 2:
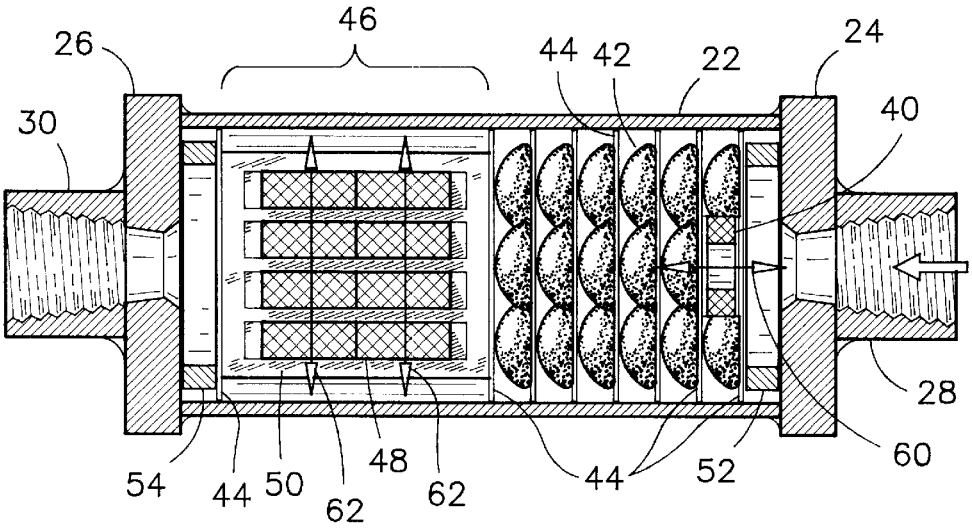
FIG. 2 is a first longitudinal cross-section view through the casing of the fuel modification device of the first preferred embodiment along line 2—2 in FIG. 1.
Figure 3:
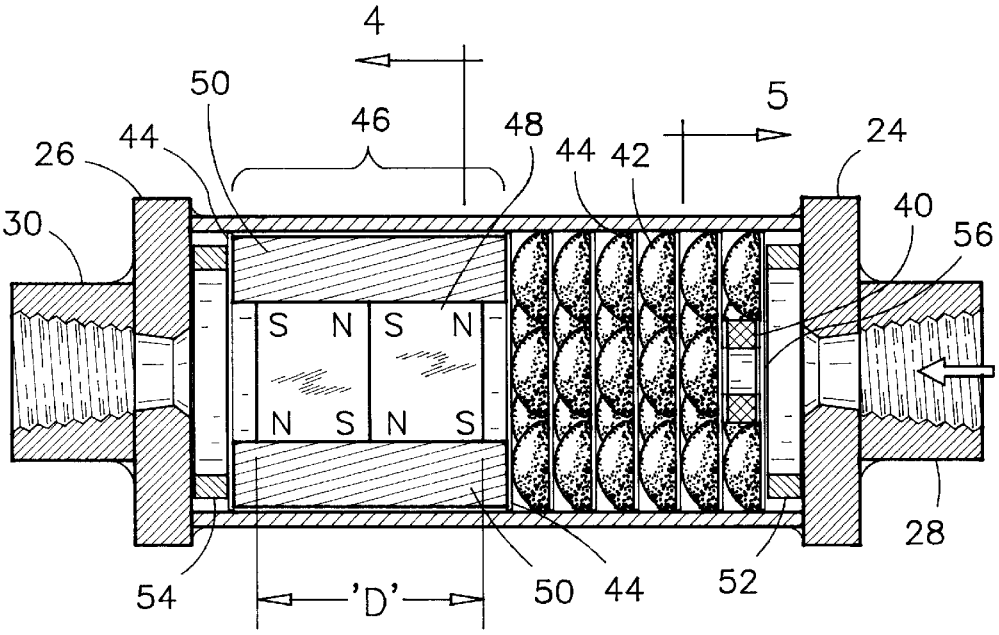
FIG. 3 is a second longitudinal cross-section view through the casing of the fuel modification device of the first preferred embodiment along line 3—3 in FIG. 1.
Figure 4:
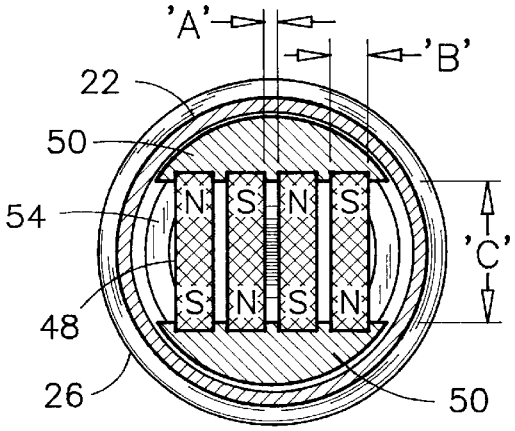
FIG. 4 is a transversal cross-section view through the casing of the fuel modification device of the first preferred embodiment along line 4 in FIG. 3.
Figure 5:
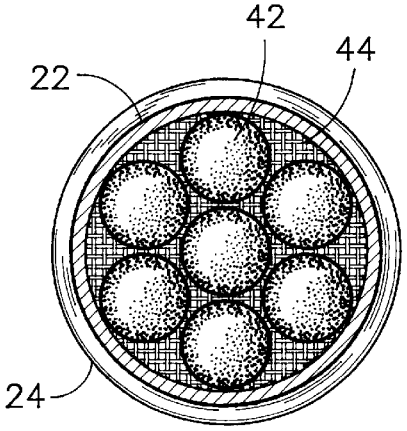
FIG. 5 is a transversal cross-section through the casing of the fuel modification device of the first preferred embodiment, along line 5 in FIG. 3, showing several catalytic pellets and a Monel screen.
Figure 6:
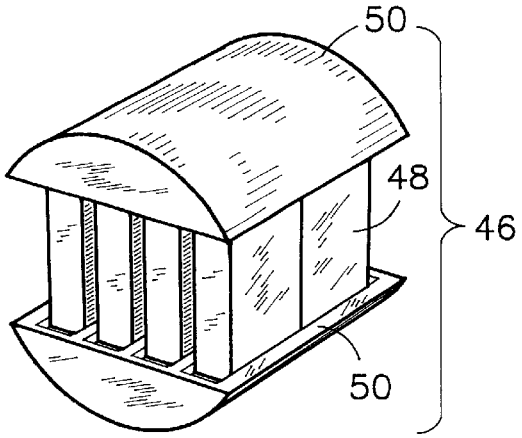
FIG. 6 is a side and outlet end perspective view of the array of rectangular magnets inside the fuel modification device of the first preferred embodiment.
Figure 7:
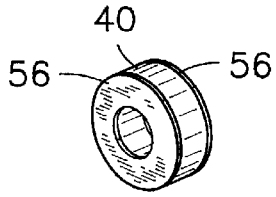
FIG. 7 is a side and end perspective view of the ring magnet mountable at the inlet end of the fuel modification device of the first preferred embodiment.

A first preferred embodiment of a fuel modification device 20 according to the present invention is illustrated in FIGS. 1–7. The fuel modification device 20 of the first preferred embodiment comprises a cylindrical casing 22 closed by an inlet cap plate 24, and an outlet cap plate 26. An inlet fitting 28 is provided in the inlet cap plate, and an outlet fitting 30 is provided in the outlet cap plate. The casing 22 is preferably made with a mechanical steel tubing and the cap plates 24,26 are preferably welded thereto. The inlet and outlet fittings 28,30 are also preferably welded to the cap plates 24,26 respectively. The welded construction is preferred herein for preventing any possible leak during extended use of the device in vibrating or similarly harsh conditions, and for meeting all the statutory regulations related to pressure piping and fuel delivery systems.

The fuel modification device 20 of the first preferred embodiment contains, in sequence from the inlet fitting 28 to the outlet fitting 30, a ring magnet 40, several layers of catalytic pellets 42, wherein each layer is separated by a screen 44, and an array 46 of rectangular magnets 48. A pair of screens 44 also encloses the array 46 of rectangular magnets without touching the magnets.

The rectangular magnets 48 are held in an orderly manner in a pair of magnet holders 50. The magnet holders 50 are preferably made of a mixture of plastic and fibreglass or an aluminium allow material. In both cases the material of construction is able to withstand temperatures of at least 100 degrees Celsius, and the erosive environment of all types of liquid fossil fuels.

The layers of catalytic pellets 42 and the array 46 of magnets are held tightly between the inlet cap plate 24 and the outlet cap plate 26 by an inlet spacer 52 and an outlet spacer 54. The thickness of each spacer 52,54 is selected to provide a slight axial compression force against the catalytic pellets 42 prior to welding the cap plates 24,26 to the casing 22.

The catalytic pellets 42 are preferably moulded in the shape of cones having a flat surface and a rounded surface. The cones are preferably installed with the flat surface facing the inlet fitting 28 in order to prevent cavitation of the fuel flowing there-around. The preferred volume of each pellet is about 0.1404 cubic inches with a preferred surface area of about 0.5184 square inch.

The preferred composition of each catalytic pellet 42 is as follows, by weight:

Bismuth: 2%–7%;

Mercury: 3%–7%;

Tin: 70%–80%;

Antimony: 15%–25%.

The fuel modification device 20 of the first preferred embodiment is manufactured in several size. The capacity of each unit is determined by the length of the casing 22 and the number of catalytic pellets 42 therein. Typical dimensions and capacities of several common models are listed below. In each model, the casing 22 is made of a mechanical steel tubing having a nominal outside diameter of 3 inches, and a wall thickness of about 0.150 inch.

| Model | Casing Length | Catalytic Pellets | Nominal Capacity |
|---|---|---|---|
| C-40 | 5.50 inches | 24/3 layers | 0.5 Imp. Gal./Min |
| C-60 | 5.75 inches | 48/6 layers | 1.0 Imp. Gal./Min |
| C-80 | 6.50 inches | 64/8 layers | 1.5 Imp. Gal./Min |
| C-100 | 7.75 inches | 88/11 layers | 2.0 Imp. Gal./Min. |
| C-150 | 10.50 inches | 136/17 layers | 3.0 Imp. Gal./Min. |
| C-200 | 11.75 inches | 160/20 layers | 3.5 Imp. Gal./Min. |
| C-250 | 13.00 inches | 184/23 layers | 4.0 Imp. Gal./Min. |

The number of catalytic pellets 42 in each model has been selected to provide a referential volume/surface factor corresponding to the net fuel volume inside the casing over the total catalyst surface area, expressed in cubic inch and square inch respectively, of no less than 0.4 inch and no more than 1.6 inch. It has been found that better performances are obtained with fuel modification devices having catalyst contents corresponding to a volume/surface factor being within these values.

It has also been found that the catalytic action of the devices is more efficient when the catalytic pellets 42 are slightly magnetized. Therefore, the ring magnet 40 is preferably placed centrally amongst the upstream-most layer of pellets 42. Steel washers 56 are preferably placed, one on each side of the ring magnet 40 to prevent erosion of the magnetic material and to better extend the magnetic field to the screens 44 enclosing the upstream-most layer of pellets 42.

It should be noted that the flux lines of magnetic field of the ring magnet 40 are oriented longitudinally relative to the direction of flow of the fuel through the casing 22. The orientation of the flux lines of the ring magnet 40 is represented by arrow 60 in FIG. 2. The preferred maximum field strength of the ring magnet 40 is about 4000 Gauss.

Each rectangular magnet 48 in the array of rectangular magnets also preferably has a maximum field strength of about 4000 Gauss. The array 46 of rectangular magnets preferably contain eight (8) rectangular magnets 48 longitudinally joined in pair and held in the set of holders 50. Each pair of magnets 48 is spaced apart from an adjacent pair a distance 'A' of not more than between about 3 mm to 5 mm (0.120 to 0.200 inch), such that the fuel is able to flow there-between and is exposed to a relatively strong magnetic field.

Each rectangular magnet 48 has its poles oriented in opposite direction relative to the abutting longitudinal magnet within the same pair, and relative to the adjacent juxtaposed magnet, such that the magnetic fields in the entire array develop attracting forces. It should be noted that the direction of the flux lines in the rectangular array of magnet is oriented perpendicularly relative to the flow of fluid through the device, as illustrated by arrows 62 in FIG. 2.

The magnets 40,48 are of the commercial Grade 2; an anisotropic type containing strontium fernite ($SrO_6Fe_2O_3$). Strontium acts as a catalyst-reducing agent when water is present in the fuel, as will be explained later. The total surface area of the array 46 of rectangular magnets 48 which is in contact with the fuel is preferably at least about 180 $cm^2$ (28 $in^2$). That is eight (8) times the thickness 'B' of one magnet, times the transversal width 'C' of one magnet, times the longitudinal length 'D' of a pair of abutting magnets 48. These dimensions are selected such that the dwell time of the fuel between the magnets 48 is preferably between about 0.5 to 1.5 seconds.

The combination of orthogonal flux lines 60,62 is believe to promote the breaking down of clusters of molecules within the fuel and to facilitate the catalytic and electrolytic processes of the device of the first preferred embodiment.

The screens 44 are preferably made of Monel metal; an alloy mainly of copper and nickel. The copper and nickel also act as catalyst materials to further improve the treatment of the fuel.

It has been found that when water is present in the fuel, the fuel is slightly acidic. Thus the presence of dissimilar metals in a slightly acidic environment causes an electrolytic reaction to occur in the fuel. It is believed that an electrolytic reaction occurs inside the fuel modification device of the first preferred embodiment, between the catalytic pellets 42 and the screens 44, between the screens 44 and the magnets 40,48, and between the magnets 40,48 and the catalytic pellets 42.

It is believed that the combination of the catalytic pellets, the Monel screens and the strontium of the magnets causes a better electrolytic reaction to substantially increase the kinetic motion within the molecules of the fuel, to help reform the fuel. It is also believed that magnets containing barium would also provide a similar effect as the strontium type, because both metals have a great affinity for oxygen.

It is further believed that when the fuel flows through the flux lines 62 of the array 46 of rectangular magnets, an electrical current is generated in the fuel to further enhance the breaking down of the water molecules present in the fuel. It was taught by Faraday that when a conductor, which in this case is the fuel, is moved perpendicularly across the flux lines of a magnetic field, an electric current is generated in this conductor. This phenomenon is believed to cause the magnets 48 to become negatively charged as the field or stator of a generator. The flowing fluid tends to become positive as an armature or a rotor of a generator.

It is believed that this current together with the kinetic motion of the catalytic, magnetic and the electrolytic action of the strontium raise the energy levels sufficiently to break down water molecules in the fuel to ionize the hydrocarbon molecules and to cause the cationic oxygen molecules to bond to the anionic hydrocarbon molecules as oxygenates.

The metal of the magnets 40,48 is believed to contribute largely to the efficiency of the fuel modification devices of the preferred embodiments. It is believed that the characteristic features of Group II elements (strontium and barium) are their good metallic properties, their strength as reducing agents and their formation of compounds in which they show oxidation state +2. Strontium ($SrCO_3$) for example has an atomic weight of 38 and an electron configuration of: 2,8,18,8,2. Its oxidation potential in volts is +2.89. The oxidation potentials are relatively high: $M(s) \rightarrow M^{++} + 2e^-$. This indicates that in an aqueous solution, strontium and barium are good reducing agents. They have the ability to react with water to release hydrogen by the reaction: $M(s) + 2H_2O \rightarrow M^{++} + H_2(g) + 2OH^-$. Although it takes a fair amount of energy to pull two electrons off a Group II atom, the net process $M(s) \rightarrow M^{++}(ag) + 2e^-$ nevertheless has a tendency to occur because the doubly charged ion interacts strongly with water in forming the hydrated ion.

The efficiency of the fuel modification devices of the first preferred embodiment is appropriately illustrated in the following typical example. On Dec. 11, 1997, at Steel and Engine Products Limited, in Liverpool, Nova Scotia, Canada, a C-60 model of the fuel modification device was installed on a 170 H.P. Isuzu diesel engine driving a water-break dynamometer. The output power of that engine has immediately increased by an average of 11 B.H.P., or 12.7%, over the entire range of operation of that engine.

Further testing on the above installation as well as on numerous other fuel modification devices of the first preferred embodiment has revealed the following results:

1) Reduced exhaust emissions of up to:
   a) 60% for gaseous hydrocarbon emissions;
   b) 25% for nitrous oxide emissions;
   c) 60% for carbon monoxide emissions;
   d) 40% for soot & particulate emissions;
   e) 90% for polynuclear aromatic hydrocarbons;
   f 7% for carbon dioxide emissions.
2) Reduced fuel consumption:
   a) an average of 7% for diesel fuel at approx. 80% MCR;
   b) an average of 4% for heavy fuel oil at approx. 80% MCR;
   c) an average of 5% for intermediate fuel oil at approx. 80% MCR.
3) Reduced exhaust gas temperatures:
   Due to improved scavenging, reductions of exhaust gas temperature are approximately 15 degrees Celsius for the same engine loads.
4) Cleaner combustion chamber & turbo blades:
   The improved combustion process reduced the amount of unburnt and partially burnt hydrocarbons that stick to the combustion chamber, valves, exhaust ports and turbo blades. Reduction in combustion soot of up to 50% has been recorded.
5) Improved turbo performance:
   The increase in turbo boost pressure has been noted by many operators. The increase usually 1 to 1.5 psi (0.1 bar) has been shown to be proportional to an increase in engine power. Due to the reduction in soot and carbon, this increase in efficiency has usually been maintained for period of up to one year where normally turbo boost pressure quickly drops and becomes less efficient as carbon and soot starts to collect on the turbo blades.
6) Cleaner fuel system components and less wear:
   Due to the change in the fuel molecular structure, the lubricity of the fuel has been enhanced. A substantial increase in naphthalene, a hydrocarbon range that is recognized for its lubricating properties, has been found in fuel treated by the fuel modification device of the first preferred embodiment. Moreover, fuel injector cleaning and replacement times have been extended by several months.

Figure 8:
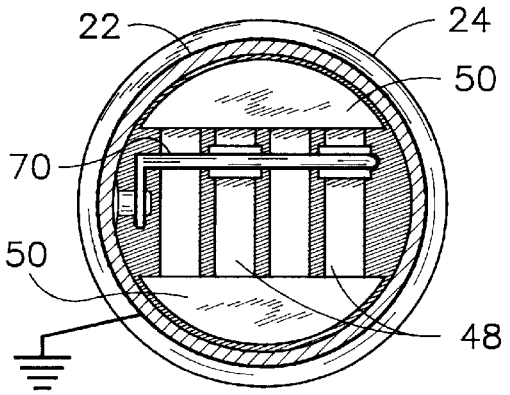
FIG. 8 is an outlet end view of the casing and the array of rectangular magnets inside the fuel modification device of the second preferred embodiment.
Figure 9:
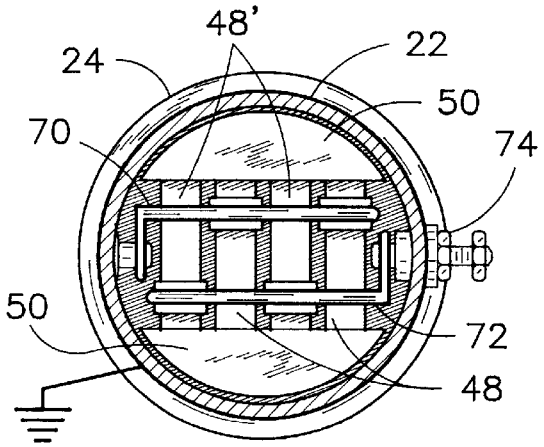
FIG. 9 is an outlet end view of the casing and the array of rectangular magnets inside the fuel modification device of the third preferred embodiment.
Figure 10:
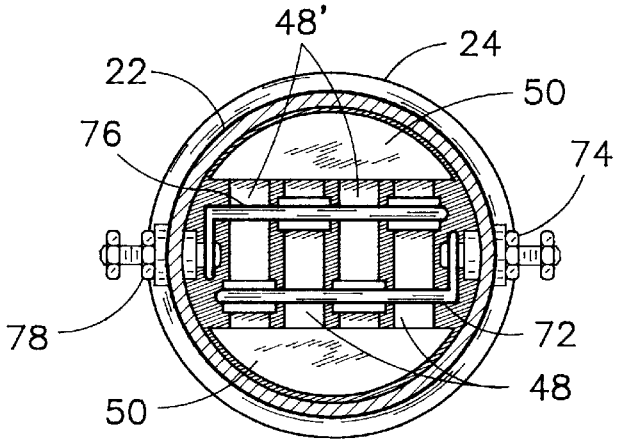
FIG. 10 is an outlet end view of the casing and the array of rectangular magnets inside the fuel modification device of the fourth preferred embodiment.

Referring now to FIGS. 8, 9 and 10, there are illustrated therein the respective characteristics of a second, third and fourth preferred embodiments of the fuel modification devices of the preferred embodiment. Because it is believed that an electric current is generated between the hydrocarbon fuel and the array 46 of magnets, it is also believed that further advantages may be obtained by grounding at least some of the magnets 48, for causing a slight electrostatic field to occur between the magnets 48 and through the hydrocarbon fuel.

Although the operations of the second, third and fourth preferred embodiments are not fully understood and documented, the structural characteristics of these embodiments are nevertheless illustrated and described herein with a statement of caution to the users of these embodiments. The installation of a device of the second, third or fourth preferred embodiments should be done in such a way to prevent any accumulation of hydrogen in the fuel line, carburettor, fuel tank or burner nozzle on which the device is installed.

Thus, in the second preferred embodiment, two alternate pairs of magnets 48 are electrically connected to the casing 22 by a first conductor 70. In this case, the casing 22 should be electrically grounded. In the third preferred embodiment, as illustrated in FIG. 9, two alternate pairs of magnets 48 are grounded to the casing 22 through the connector 70 while the two other alternate pairs of magnets 48 are connected by a second conductor 72 to a first terminal 74 insulated from the casing, and to which a source of voltage may be applied. In the fourth preferred embodiment, both pairs of alternate magnets 48, 48' each have conductors 72,76 connected thereto and connected respectively to a first and second terminals 74,78 which are insulated from the casing and to which a source of electrical power may be connected.

While the above description provides a full and complete disclosure of the preferred embodiments of this invention, various modifications, alternate constructions and equivalents may be employed without departing from the true spirit and scope of the invention. Such changes might involve alternate materials, components, structural arrangements, sizes, operational features or the like. Therefore, the above description and accompanying illustrations should not be construed as limiting the scope of the invention which is defined by the appended claims.

I claim:

1. A fuel modification device for improving the combustion of an hydrocarbon fuel, comprising;

a casing having an inlet fitting, an outlet fitting and a flow axis between said inlet fitting and said outlet fitting;

said casing enclosing a plurality of catalytic pellets held in layers by at least two spaced-apart Monel screens positioned perpendicularly relative to said flow axis, at least one of said catalytic pellets containing by weight 2–7% bismuth; and at least one magnet positioned adjacent to and without touching, one of said Monel screens, said magnet containing at least one element from a group of elements comprising strontium and barium, whereby when said fuel is adapted to flow through said casing and when said fuel contains water, an electrolytic action is generated through said fuel between said Monel screen and said magnet for breaking said water content into oxygen and hydrogen radicals of said water content.

2. The fuel modification device as claimed in claim 1 wherein said at least one of said catalytic pellets also comprises the following elements and composition percentages by weight: 3–7% mercury, 70–80% tin; and 15–25% antimony.

3. The fuel modification device as claimed in claim 2 wherein each said pellet has a surface area of about 0.5184 square inch.

4. The fuel modification device as claimed in claim 3, wherein said casing has a nominal capacity and said nominal capacity is related to a factor representative of a net fuel volume inside said casing divided by a total surface area of said catalytic pellets, and said factor is between about 0.4 inch to about 1.6 inches.

5. The fuel modification device as claimed in claim 1, wherein said magnet comprises an inlet magnet mounted inside said casing near said inlet fitting.

6. The fuel modification device as claimed in claim 5, wherein said inlet magnet is a ring magnet and said layers of catalytic pellets comprises an upstream-most layer closest to said inlet fitting, and said ring magnet is positioned centrally amongst said catalytic pellets in said upstream-most layer.

7. The fuel modification device as claimed in claim 6 wherein said ring magnet has a maximum field strength of about 4000 Gauss.

8. The fuel modification device as claimed in claim 1 wherein said magnet comprises an array of rectangular magnets mounted inside said casing near said outlet fitting, said array containing a plurality of juxtaposed abutting pairs of rectangular magnets with each magnet having its poles oriented in opposite direction relative to a joining magnet within a same abutting pair and relative to an adjacent magnet within a juxtaposed pair, such that said array of magnet develop attracting magnetic forces.

9. The fuel modification device as claimed in claim 8 wherein said array of rectangular magnets comprises flux lines that are oriented perpendicularly to said flow axis.

10. The fuel modification device as claimed in claim 9 wherein said juxtaposed abutting pairs of magnets are spaced apart from one-another a distance of between about 0.120 inch (3 mm) to about 0.200 inch (5 mm), such that said fuel is able to flow there-between.

11. The fuel modification device as claimed in claim 10 wherein each said magnet in said array of rectangular magnets has a maximum field strength of about 4000 Gauss.

12. The fuel modification device as claimed in claim 11, wherein a total exposed surface area of said array of rectangular magnets is about 28 square inch (180 $cm^2$).

13. The fuel modification device as claimed in claim 11, further comprising an electrical connection between said casing and at least one of said abutting pair of magnets.

14. The fuel modification device as claimed in claim 11, wherein said juxtaposed abutting pairs of magnets comprises a first and second spaced-apart sets each comprising two abutting pairs of magnets, said first set being mounted astride one of said abutting pair in said second set and vice-versa; said first set comprising a first electrical conductor means connected thereto and to said casing.

15. The fuel modification device as claimed in claim 14, further comprising a second electrical conductor means connected to a said second set, said second electrical conductor means being electrically insulated from said casing and extending outside said casing such that a source of electric power is connectable thereto and to said second set of magnets.

16. The fuel modification device as claimed in claim 11, wherein said juxtaposed abutting pairs of magnets comprises a first and second alternating sets each comprising two abutting pairs of magnets, said first set being mounted astride one of said abutting pair in said second set and vice-versa; said first set comprising a first electrical conductor means connected thereto and extending through and being insulated from said casing, and said second set comprising a second electrical conductor means connected thereto and extending through and being insulated from said casing and from said first electrical conductor means, such that a source of electrical power is connectable between said first and said second set of magnets.

17. A fuel modification device for improving the combustion of an hydrocarbon fuel, comprising;

a casing having an inlet fitting, an outlet fitting and a flow axis between said inlet fitting and said outlet fitting; said casing enclosing in sequence from said inlet fitting to said outlet fitting:

a ring magnet having flux lines aligned along said flow axis;

a plurality of catalytic pellets held in layers by at least two spaced-apart Monel screens positioned perpendicularly relative to said flow axis;

at least one of said catalytic pellets comprising the following elements and composition percentages by weight: 2–7% bismuth; 3–7% mercury; 70–80% tin; and 15–25% antimony; and an array of rectangular magnets enclosed between and without touching a pair of Monel screens, said rectangular magnets having flux lines perpendicular to said flow axis;

said rectangular magnet and said ring magnet containing at least one element from a group of elements comprising strontium and barium, whereby when said fuel is adapted to flow through said casing and when said fuel contains water, an electrolytic action is generated through said fuel between said Monel screen and said magnet for breaking said water content into oxygen and hydrogen radicals of said water content.

18. The fuel modification device as claimed in claim 17, wherein said casing is made of mechanical steel tubing and comprises inlet and outlet cap plates welded thereto, and said inlet and outlet fittings are welded to said inlet and outlet cap plates respectively.

19. The fuel modification device as claimed in claim 17, wherein said catalytic pellets are cone-shaped pellets having a flat surface and a rounded surface, and each said cone-shaped pellet is mounted inside said casing with said flat surface facing said inlet fitting of said casing.

20. The fuel modification device as claimed in claim 17, wherein said ring magnet comprises a pair of steel washer affixed thereto.

21. A method for improving the combustion characteristics of hydrocarbon fuels containing water impurities, said method comprising the steps of:

immersing in said fuel a first catalytic composition comprising bismuth, mercury, tin and antimony;

immersing in said fuel a first magnet containing at least one element from a group of elements comprising strontium and barium;

immersing in said fuel at proximity but without touching said first magnet a metallic alloy member comprising copper and nickel;

flowing said fuel over said catalytic composition, over said alloy member and over said magnet;

causing an electrolytic action to occur in said fuel;

causing some hydrocarbon molecules in said fuel to become ionized;

causing some oxygen radicals in said fuel impurities to bond to said hydrocarbon molecules as oxygenates.

22. The method as claimed in claim 21, further comprising the additional steps of:

freeing hydrogen radicals from said water impurities; and causing some of said hydrogen radicals to join hydrocarbon chains within said fuel for forming new and shorter hydrocarbon chains.

23. The method as claimed in claim 21, wherein said catalytic composition comprises bismuth, mercury, tin and antimony.

24. The method as claimed in claim 23, wherein said catalytic composition comprises the following percentages by weight: 2–7% bismuth; 3–7% mercury; 70–80% tin; and 15–25% antimony.

25. The method as claimed in claim 21 wherein said magnet comprises spaced-apart upstream and downstream magnets astride said catalytic composition, and said step of flowing said fuel over said magnet comprises the step of flowing said fuel over said upstream and downstream magnets.

26. The method as claimed in claim 25 wherein said upstream and downstream magnets each has a maximum field strength of about 4000 Gauss.

27. The method as claimed in claim 25, wherein said flowing said fuel over said magnets comprises the step of flowing said fuel along flux lines of said upstream magnet and across flux lines of said downstream magnet.

28. The method as claimed in claim 27, wherein a dwell time of said fuel flowing across said flux lines of said downstream magnets is between about 0.5 to about 1.5 seconds.

29. The method as claimed in claim 25 wherein said downstream magnets comprises a plurality of spaced apart rectangular magnets, and said method further comprises the steps of electrically grounding at least one of said rectangular magnets in said plurality.

30. The method as claimed in claim 21, wherein said catalytic composition comprises a plurality of cone-shaped pellets each having a rounded surface and a flat surface, and said step of flowing said fuel over said catalytic composition comprises the step of flowing said fuel against said flat surfaces and along said rounded surfaces of said pellets.

* * * * *